US006099049A

United States Patent [19]

Peng

[11] Patent Number: 6,099,049

[45] Date of Patent: Aug. 8, 2000

[54] QUICK RELEASABLE MOUNTING FOR WINDOW GUARDS

[76] Inventor: George Yin-Shih Peng, 1363 Selo Dr., Sunnyvale, Calif. 94087

[21] Appl. No.: 08/758,384

[22] Filed: Nov. 29, 1996

[51] Int. Cl.[7] ..... E05C 5/04

[52] U.S. Cl. ..... 292/251; 292/175; 292/145; 292/DIG. 20; 292/DIG. 47

[58] Field of Search ..... 292/57, 60, 62, 292/175–177, 189, 145, 155, 251, 302, 355, DIG. 20, DIG. 33, DIG. 46, DIG. 47, DIG. 65; 49/50–57

[56] References Cited

U.S. PATENT DOCUMENTS

| | | | |
|---|---|---|---|
| 426,303 | 4/1890 | McGovern | 292/251 X |
| 503,201 | 8/1893 | Doebler | 292/355 |
| 533,839 | 2/1895 | Case | 292/355 |
| 1,398,036 | 11/1921 | Nichols | 292/251 |
| 1,433,584 | 10/1922 | Wilson | 49/56 |
| 1,440,872 | 1/1923 | Geurink | 292/251 X |
| 1,671,117 | 5/1928 | Lyddane | 292/355 X |
| 3,203,718 | 8/1965 | Bishop | 292/251 X |
| 3,343,581 | 9/1967 | Martin et al. | 292/251 X |
| 3,794,365 | 2/1974 | Richberg | 292/62 |
| 3,847,422 | 11/1974 | Goustan | 292/251 X |
| 3,913,957 | 10/1975 | Astie et al. | 292/DIG. 65 X |
| 3,921,334 | 11/1975 | Black, Sr. | 49/56 |
| 4,050,723 | 9/1977 | Papadatos | 292/177 X |
| 4,057,935 | 11/1977 | Rohrberg et al. | 49/56 |
| 4,111,477 | 9/1978 | Rigali | 292/252 |
| 4,138,150 | 2/1979 | Bills | 292/DIG. 20 X |
| 4,771,574 | 9/1988 | Stephens | 292/175 X |
| 4,917,416 | 4/1990 | Westphal et al. | 292/175 |
| 5,022,690 | 6/1991 | Coltrin et al. | 49/56 X |
| 5,160,180 | 11/1992 | Mlynarczyk | 292/251 X |
| 5,464,261 | 11/1995 | Alkhoury | 292/DIG. 47 X |

*Primary Examiner*—Suzanne Dino Barrett

[57] ABSTRACT

A quick, easy and reliable release for window guards from the inside so that windows are not eliminated as an escape route from the inside when window guards must be removed on an expedited basis, which quick releasable mounting is effective for use with at least one of wood, metal, concrete and brick stud walls. Likewise, a process for the quick release of those guards found around windows in the event of an emergency, when the only available route out of the building may be the window is taught by use of construction including, in combination, an elongated cylindrical casing, a threaded flange, a resilient cap, a retractable flat locking member, a conical tail key, a flat bracket connector, a pair of springs, and a mounting base.

13 Claims, 6 Drawing Sheets

Section B

QUICK RELEASABLE MOUNTING FOR WINDOW GUARDS

BACKGROUND OF THE INVENTION

The present invention relates to means for facilitating the quick release of safety guards, or bar structures, associated with windows. In particular, the present invention relates to apparatus effective for the quick release of metal guards disposed about any window opening found in a building or related structure. Likewise, the present invention teaches a process for the quick release of those guards found around windows or related structures—for example—in the event of an emergency, when the only available route out of the building may be the window or related aperture.

Many homes and buildings are equipped with window guards, or the like structural homologues, for several purposes. Prominent among these purposes are securing the window openings from intruders and other unwanted ingress's, and in some instances these structures may be required for preventing small children from passing outward through them. Conventional window guards which keep intruders out, unfortunately may also prevent emergency egress, which has resulted in numerous injuries and fatalities. Likewise, known lock release brackets and associated levers have failed to adequately address this serious drawback.

As reported in recent news stories, during natural disasters including, for example, fires, window guards which could not be removed from the inside have caused people to be trapped and burned or otherwise traumatized to death. The teachings of the present invention have ameliorated this longstanding problem, and on this basis should be recognized as constituting progress in science and the useful arts.

By way of background, attention is called to the following United States Letters Patents which have each been examined during the course of the present invention and found to be technically distinguishable from the instant teachings, as claimed subject matter created by the present inventor which is respectfully submitted to be new, novel and unobvious within the definition prescribed by statute:

U.S. Pat. Nos. 5,428,924; 4,838,001; 4,624,072; 4,467,574; 4,593,492; 3,942,764;

U.S. Pat. No. 5,428,924; for example, which issued on Jul. 4, 1995 to Pifer disclosed a High Security Window/Door Apparatus. U.S. Letters Pat. No. 5,428,924 ("the '924 patent") disclosed two transparent panes in parallel, spaced apart relation which were mounted on the inner periphery of a sash. The purpose of the '924 patent was to prevent ingress by creating the appearance of a multi-pane window. The '924 patent, in contrast to the present invention, was not disposed through the wall of the frame surrounding a window.

Likewise, U.S. Letters Pat. No. 4,838,001; ("the '001 patent") which issued Jun. 13, 1989 to Battles, for removably attaching a decorative window grid to a window sash, is directed at creating a visual impression that a single window pane is actually comprised of a plurality of window panes carried adjacent to one another. In contradistinction to the '001 patent—the teachings of the present invention provide for rapid and facile detachment of conventional window guard and bar member.

U.S. Letters Pat. No. 4,624,072; also discloses a device which is not readily detachable, as in the case of the instant teachings—rather this patent would not be substantially detached, in contradistinction to the present invention.

Further, U.S. Letters Pat. No. 4,467,574; discloses an additional device which is not readily removable due to its nature as threadedly engaged (with the use of screw means) such that it could not rapidly be detached. The present invention is designed to overcome each of these shortcomings, and provide for readily accessible egress through an opening, such as window, which heretofore stood blocked in the event of an emergency.

It is respectfully submitted that each of the other references merely defines the state of the art or shows the type of systems which have been used to alternately address those issued ameliorated by the teachings of the present invention. Accordingly, further discussions of these references has been omitted at this time due to the fact that they are readily distinguishable from the instant teachings to one of skill in the art.

In sum, no disclosures among the prior art have addressed those problems solved by the instant teachings, which demonstrates the contributions of the present inventor to the solution of the longstanding problem of people being trapped within structures by metal bars or the like window guards.

OBJECTS AND SUMMARY OF THE INVENTION

Accordingly, it is an object of this invention to provide an apparatus effective for the quick release of metal guards disposed about any window opening found in a building or related structure, which eliminates the drawbacks of the prior art.

It is another object of the present invention to provide to means for facilitating the quick release of safety guards, or bar structures, associated with windows.

An additional object of the present invention is to provide a quick, easy and reliable release for window guards from the inside so that windows are not eliminated as an escape route from the inside when window guards are used for protection, with at least one of wood, metal, and brick stud walls.

It is yet a still further object of the present invention to provide a process for the quick release of those guards found around windows in the event of an emergency, when the only available route out of the building may be the window.

Briefly stated, a quick, easy and reliable release for window guards from the inside so that windows are not eliminated as an escape route from the inside when window guards must be removed on an expedited basis, which quick releasable mounting is effective for use with at least one of wood, metal, concrete and brick stud walls. Likewise, a process for the quick release of those guards found around windows in the event of an emergency, when the only available route out of the building may be the window is taught by use of construction including, in combination, an elongated cylindrical casing, a threaded flange, a resilient cap, a retractable flat locking member, a conical tail key, a flat bracket connector, a pair of springs, and a mounting base.

According to an embodiment of the present invention, there is provided a quick releasable mounting construction, which comprises, in combination; an elongated cylindrical casing, means for readily engaging said construction from a window guard bracket connector fittable to a conventional window, means for locking said elongated cylindrical casing in a first position relative to a conventional window guard's bracket connector, means for readily disengaging said construction from a window guard bracket connector fittable to a conventional window.

According to another embodiment of the present invention, there is provided a quick releasable window guard, which comprises; an elongated cylindrical casing, having a first end, a second end, an interior and an exterior, said exterior has, a threaded first end extending inwardly to a predetermined marginal distance, and a substantially smooth second end extending opposite and inwardly to said predetermined marginal distance, said elongated cylindrical casing has an interior cavity wherein said cavity is concentrically divided by a first shoulder and a second shoulder, wherein said second shoulder is substantially larger then said first shoulder, each of said shoulders respectively have a slot, a chamfered front end, and a flat-faced rear end, said first shoulder is located proximately adjacent said predetermined marginal distance of said threaded first end and said second shoulder is located central to said elongated cylindrical casing, a threaded flange wherein said threaded flange has an interior thread diameter substantially equal to an outer diameter of said threaded first end upon said exterior of said elongated cylindrical casing, a resilient cap, having an interior cavity with an internal diameter substantially equal to said exterior diameter of said threaded first end of said elongated cylindrical casing, extending from a base inwardly to a crown of said resilient cap, wherein said cavity has a threaded interior diameter extending from said base inwardly to a predetermined distance, said crown has a plurality of symmetrical recesses, straddling a central portion of said cap, said resilient cap has a means for threaded fastening to said threaded first end of said cylindrical casing wherein said resilient cap seats adjacent to said threaded flange, a retractable flat locking member slidingly disposed within said interior of said elongated cylindrical casing wherein said retractable flat locking member has a pair of scissor tails extending from a shank connected to a base wherein said base has a notched distal end, at least one of said scissor tails has a chamfered outside edge disposed adjacent an end of said scissor tail wherein said scissor tail is juxtaposed adjacent said first, shoulder in said slot and said shank is deposed between said second shoulder, a flat tail key having a circular base wherein said flat tail key tapers inwardly in an axially direction from said circular base, towards said second end of said elongated cylindrical casing, forming a rounded terminal end, wherein said rounded terminal end is adapted to slidingly engage an interior portion of said scissor tails forcing said chamfered outside edges of said scissor tails adjacent said first shoulder thereby trapping said scissor tails between said flat tail key and said first shoulder, said circular base is seated and said flat tail key is disposed adjacent said crown of said resilient cap, a flat bracket connector having a concentric circular flange disposed between a second notched end and an outwardly extended flange wherein said second notched end is adapted to reversibly hook to said first notched base of said flat locking member within said elongated cylindrical casing, wherein said concentric circular flange seats upon an outer rim of said second end of said elongated cylindrical casing, and, a pair of springs, one of said springs is positioned between said base of said conical tail key and said threaded first end, an outer rim of said first end, of said elongated cylindrical casing, wherein said spring is adapted to urge said flat tail key, scissor tail, outwardly from said elongated cylindrical casing toward said front end, said second spring is disposed between said flat-faced rear end of said substantially larger shoulder said notched base of said retractable flat locking member wherein said second spring is adapted to urge said retractable flat locking member outwardly from said elongated cylindrical casing toward said rear end.

According to still another embodiment of the present invention, there is provided a quick releasable window guard which comprises; an elongated cylindrical casing, having a first end, a second end, an interior and an exterior, said exterior has, a threaded first end extending inwardly to a predetermined distance, ending and mating with a substantially smooth surface, wherein said smooth surface extends from said mating distance to a second end, said elongated cylindrical casing has an interior slotted cavity wherein said cavity is concentrically divided by a first shoulder and a second shoulder, wherein said second shoulder is substantially larger then said first shoulder, each of said shoulders respectively have, a chamfered front end, and a flat-faced rear end, said first shoulder is located proximately adjacent said mating distance of said threaded first end and said smooth surface interface, said second shoulder is located central to said elongated cylindrical casing, a threaded flange wherein said threaded flange has an interior thread diameter substantially equal to an outer diameter of said threaded first end upon said exterior of said elongated cylindrical casing, a resilient cap, having an interior cavity with an internal diameter substantially equal to said exterior diameter of said threaded first end of said elongated cylindrical casing, extending from a base inwardly to a crown of said resilient cap, wherein said cavity has a threaded interior diameter extending from said base inwardly toward said crown of said resilient cap, said crown has a symmetrical recess, straddling an extruded central portion of said cap, said resilient cap has a means for threaded fastening to said threaded first end of said elongated cylindrical casing wherein said base of said resilient cap seats sufficiently flush to said threaded flange, a retractable flat locking member slidingly disposed within said interior slotted cavity of said elongated cylindrical casing wherein said retractable flat locking member has a pair of scissor tails extending from a bisecting shank connected to a base wherein said base has a notched distal end, at least one of said scissor tail has a periphery with a chamfered outside edge juxtaposed adjacent to said first shoulder of said elongated cylindrical casing, said bisecting shank is disposed between said second shoulder of said elongated cylindrical casing, a flat tail key having a circular base wherein said flat tail key tapers inwardly and into a rounded terminal end, in an axially direction from said circular base to a distal position, wherein said distal position is central to said scissor tail of said retractable flat locking member wherein said rounded terminal end is adapted to slidingly engage an interior portion of said scissor tails forcing said peripheries of said scissor tails into a trapped position adjacent said first shoulder of said elongated cylindrical casing, said circular base seats adjacent to said crown of said resilient cap, flush with said extruded central portion thereof, a flat bracket connector having a concentric circular flange disposed between an inverted and inwardly extending notched end and an outwardly extended flat slotted end wherein said flat slotted end is shouldered by a step, said inverted and inwardly extended notched end is adapted to mate with said notched distal end of said retractable flat locking member within said interior slotted cavity of said elongated cylindrical casing, wherein said concentric circular flange seats adjacent to an outer rim of said second end of said elongated cylindrical casing, and a pair of compression springs, wherein a first compression spring is positioned between said base of said flat tail key and said threaded first end of said elongated cylindrical casing and a second compression spring disposed between said flat-faced rear end of said second shoulder and a shank-side edge of said base of said retractable flat locking member, said first compression spring is adapted to urge said flat tail key outwardly from within said interior portion of said scissor tails, said second compression spring is adapted to urge said retractable flat locking member outwardly from within said elongated cylindrical casing, said compression springs are adapted to disengage said mated notched ends.

According to a yet still further feature of the present invention, there is provided a method of quickly releasing a window guard comprising the steps of; providing a construction effective for interfacing with a conventional window and window guard assembly which construction further comprises, in combination, an elongated cylindrical casing, a threaded flange, a resilient cap, a retractable flat locking member, a conical tail key, a flat bracket connector, a pair of springs; and a mounting base; unfastening said resilient cap; and, removing said resilient cap from a front end of said cylindrical casing, allowing for a first spring to urge said conical tail key outwardly toward said front releasing flat locking bar from a hook attachment, allowing for a pair of tail keys of said flat locking bar to bias inwardly toward one another thereby releasing said flat locking bar and allowing a second spring to urge said flat locking bar outwardly toward the rear end of said elongated cylindrical casing thereby releasing a bracket connector attached to a window guard.

These and other objects are accomplished by the parts, constructions, arrangements, combinations and subcombinations comprising the present invention, the nature of which is set forth in the following general statement, and preferred embodiments of which—illustrative of the best modes in which applicant has contemplated applying the principles—are set forth in the following description and illustrated in the accompanying drawings, and are particularly and distinctly pointed out and set forth in the appended claims forming a part hereof.

In sum, the above, and other objects, features and objectives of the present invention, shall become apparent with the following description whether in conjunction with the company drawings, in which like reference numerical designating indicators designate the same elements.

BRIEF EXPLANATION OF THE DRAWINGS

FIG. 1(*b*), shows an outside partial perspective plan view of a preferred embodiment of the invention of the present invention.

FIG. 2(*b*), illustrates an isometric cross-sectional view of a preferred embodiment of the present invention.

FIG. 2(*c*) is a right side view of the quick releasable mounting device for window guards according to the preferred embodiment of the present invention.

FIG. 3(*b*) is a sectional view through line B—B of the quick releasable mounting device for window guards according to the preferred embodiment of the present invention as depicted in FIG. 3(*a*).

DETAILED DESCRIPTION OF THE PREFERRED EMBODIMENTS

The present inventor has discovered that it is possible to create a quick releasable mounting construction which enables rapid egress from a structure having conventional window guards or the like bar structures. Alternate embodiments are designed for concrete, brick or other solid wall structures and wood or metal stud walls. As will become apparent from the description below, with the latter embodiment (for wood or metal stud walls) the use of a flat bracket connector with a mounting base is not necessary as same is fastened onto the wall by means of a screwed neck flange.

The present inventor has further discovered that, in the past, egress from a building during exigent circumstances has been mechanically hindered or frustrated, resulting in numerous injuries and fatalities wherein known lock release brackets and associated levers have failed to adequately address this serious drawback. To solve this problem, the inventor of the present invention has conceived a quick releasable mounting device for window guards.

Likewise, the invention relates to an apparatus effective for the quick release of guards disposed about any window opening found in a building or related structure. Likewise, the present invention teaches a process for the quick release of those guards found around windows or related structures in the event of an emergency, when the only available route out of the building may be the window or related aperture.

Generally speaking, a window guard is held in place by a quick releasable mounting and a threaded flange is broken open or unscrewed, pressure is released from a tail key permitting a compression spring to eject same out of a mounting base cylinder. A retractable flat locking member then closes allowing a compression spring to urge the retractable flat locking member and a window guard bracket connector out of the mounting base cylinder, resulting in the release of the subject window guard from the exterior wall.

Figure 1A:
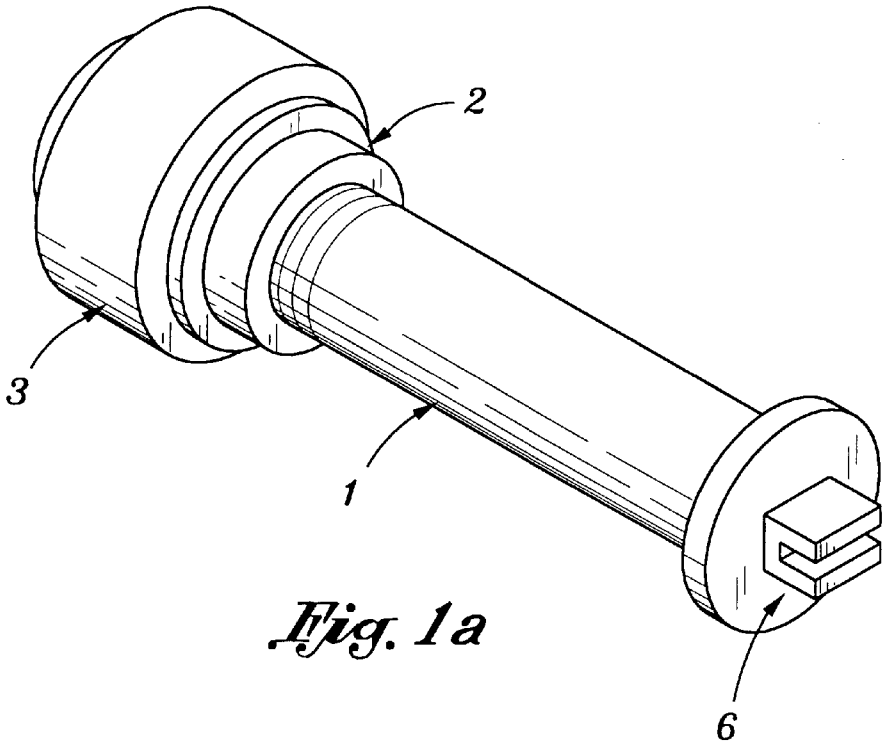
FIG. 1(*a*), shows an outside partial perspective plan view of a preferred embodiment of the invention of the present invention.
Figure 1B:
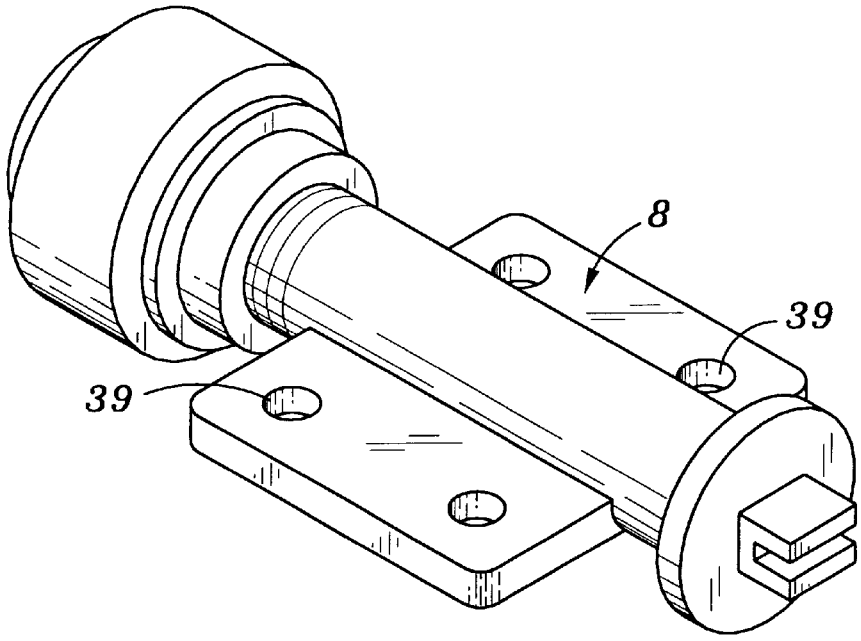
Figures 2A, 2B, 2C:
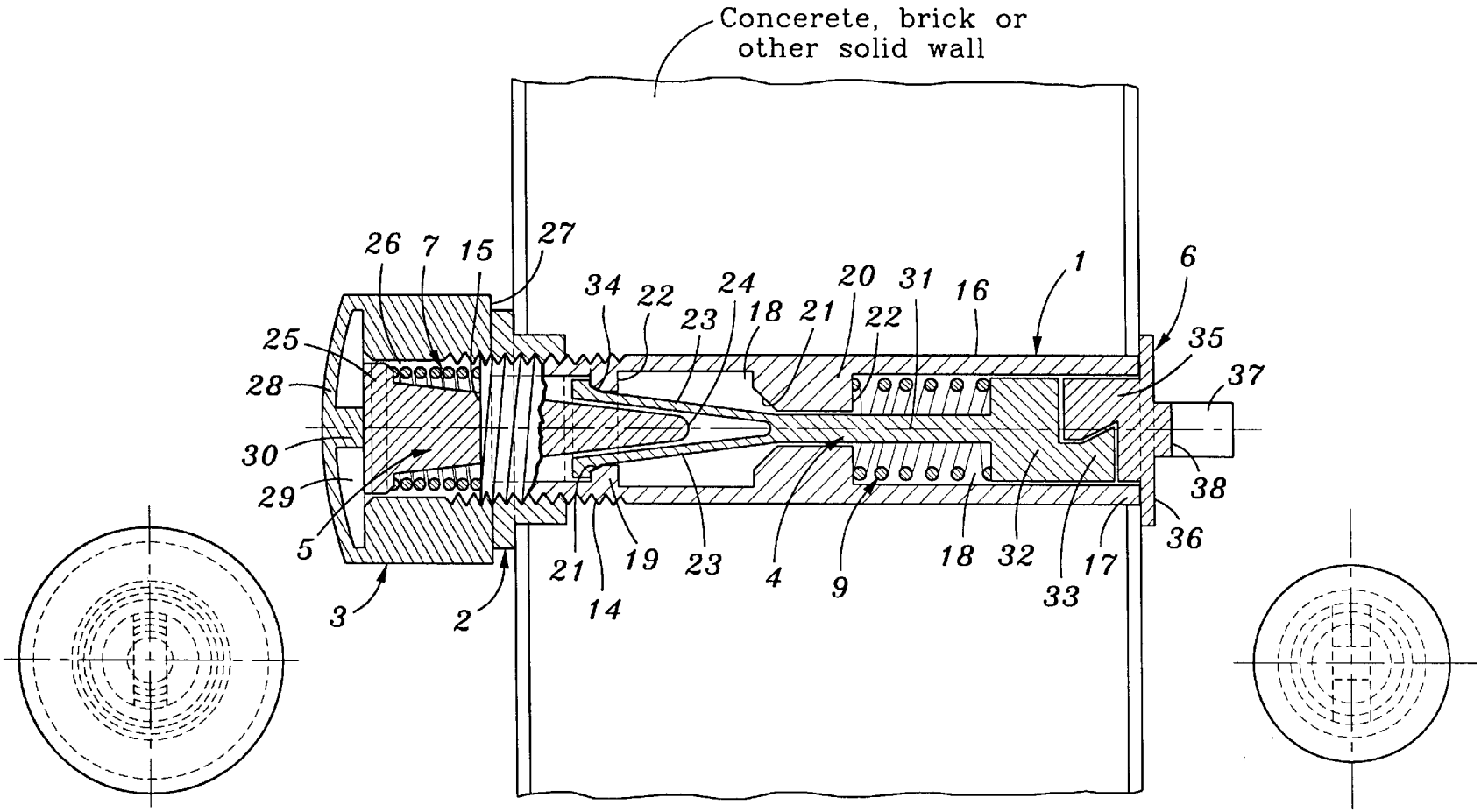
FIG. 2(*a*), illustrates a left side view of the quick releasable mounting device for window guard according to a preferred embodiment of the present invention.
Figure 3B:
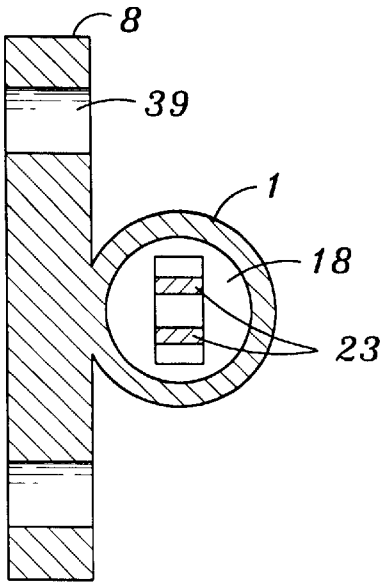
FIG. 3(*a*) illustrates an isometric cross-sectional view of an alternate preferred embodiment of the present invention, with the mounting base such as in the case of attaching same to a wall stud.
Figure 3A:
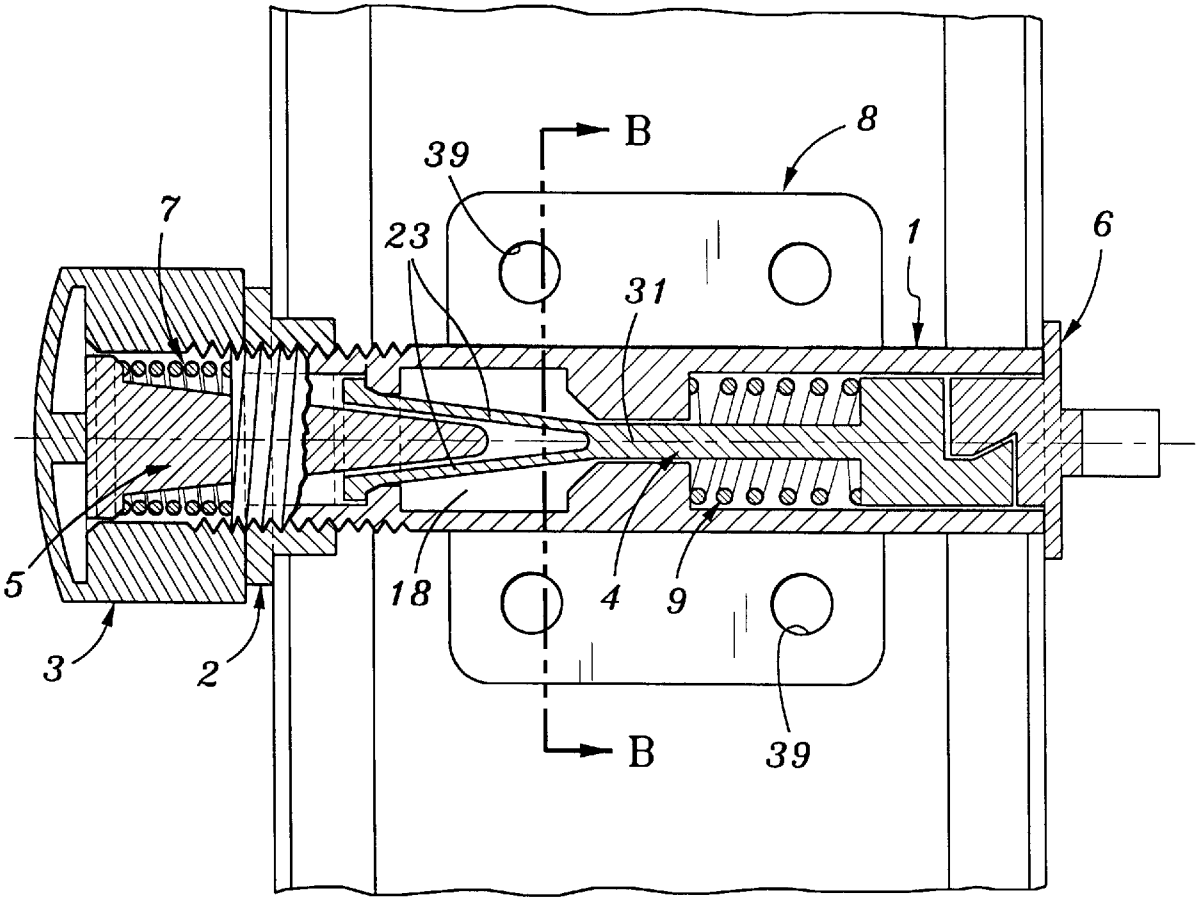

The present invention is described in detail hereunder, referring to an embodiment thereof shown in FIGS. 1 to 3, and summarized schematically, in accordance with alternate preferred embodiments which are likewise within the scope of the description of the preferred embodiment, as explained hereunder and further defined with reference to that preferred embodiment illustrated, and each of the constituent parts and elements as depicted in the figures. Common reference designators are utilized herein, with the present invention being described by way of reference to same uniformly throughout the teachings offered herein for consideration, as illustrated by representative example and defined within the appended claims.

Referring now to FIG. 1(*a*), a partial perspective plan view of a preferred embodiment of the construction of the present invention is shown. The quick releasable mounting device for window guards as schematically illustrated includes a resilient cap 3, a threaded flange 2, an elongated cylindrical casing 1, and a flat bracket connector 6.

Referring now to FIG. 1(*b*), which figure likewise illustrates a partial perspective plan view of a preferred embodiment of the construction of the present invention, as likewise depicted in FIG. 1(*a*), with the additional inclusion of a mounting base 8.

Referring now both to FIGS. 2(*a*) and 2(*c*), which figures illustrate left and right side views of the quick releasable mounting device for window guards without inclusion of the mounting base 8. The left side view of FIG. 2(*a*) depicts a hidden line representation of the components, of a quick releasable mounting device according to the teachings of the present invention, located approximately adjacent to the resilient cap 3.

The right side of FIG. 2(*c*) view demonstrates a hidden line representation, of the components, approximately adjacent to the flat bracket connector 6. Referring now to FIG. 2(*b*), a cross-sectional view through a quick releasable mounting device for window guards according to the teachings of the present invention is shown. The cross-sectional view shown in FIG. 2(*b*) depicts a preferred embodiment, as illustrated in the prior figures, in a closed position.

The elements of a preferred embodiment, as shown in FIG. 2(*b*) comprise; a resilient cap 3, a threaded flange 2, an elongated cylindrical casing 1, a flat bracket connector 6, a flat tail key 5, a retractable flat locking member 4, a first compression spring 7 and a second compression spring 9.

The elongated cylindrical casing 1, has an exterior surface with a threaded first end is 15. The elongated cylindrical casing 1 is interposed therebetween a wall having an inner and outer wall board. Both of the wall boards are perforated by a through-going aperture wherein the perforation has a diameter substantially equal to the exterior diameter of the elongated cylindrical casing 1. The threaded first end of the elongated cylindrical casing 1 extends inwardly a predetermined distance ending and mating with a smooth surface 16. The smooth surface 16 continues on from the mating position, which is relatively close to the first end, to a second location abutting a inner wallboard. The second end 17 of the elongated cylindrical casing 1 seats substantially flush with the exterior wallboard. The elongated cylindrical casing 1 has an interior slotted cavity 18 which is concentrically divided by a first shoulder 19 and a second shoulder 20. The second shoulder 20 is substantially larger then the first shoulder 19. Respectively, both of the shoulders have a chamfered front end 21, and a flat-faced rear end 22.

Referring still to FIG. 2(*b*),the relative position of the first shoulder 19 is such that it is located approximately adjacent to where the threads and smooth surface 16 upon the exterior surface of the elongated cylindrical casing 1 mate. The second shoulder 20 is located central to the elongated cylindrical casing 1. The threaded first end 15 of the elongated cylindrical casing is threadedly attached to a threaded flange 2.

The threaded flange 2 has an interior thread diameter substantially equal to that of the threaded first end 15 of the elongated cylindrical casing 1. The threaded flange 2 serves to position the elongated cylindrical casing 1 between a wall. The threaded flange 2 further acts as a seat for the resilient cap 3. The threaded flange 2 is strategically positioned upon the exterior threads of the elongated cylindrical casing 1 such that when the resilient cap 3 is threadedly attached to a position substantially flush with the threaded flange 2, the flat tail key 5, encapsulated by the resilient cap 3, slidingly engages the scissor tails 23 of the retractable flat locking member 4 causing the scissor tails 23 to open and become trapped between the interior first shoulder 19 of the elongated cylindrical casing 1 and the exterior surface of the flat tail key 5.

The flat tail key 5 has a circular base 25. When the quick releasable mounting device is in a secured closed position, the underside of the circular base 25 seats adjacent to an extruded portion contained within the crown 28 of the resilient cap 3. From the circular base 25, the flat tail key 5 tapers inwardly, and into a rounded terminal end 24, away from the circular base to a distal position. The distal position is central to the scissor tails 23 of the retractable flat locking member 4. The rounded terminal end 24 is adapted to slidingly engage between an interior portion of the scissor tails 23 of the retractable flat locking member 4, forcing the peripheries of the scissor tails to become trapped between the first shoulder 19 of the elongated cylindrical casing 1 and the flat tail key 5.

The resilient cap 3, as shown, has an interior cavity 26, with an internal threaded diameter substantially equal to the exterior diameter of the threaded first end 15 of the elongated cylindrical casing 1. The resilient cap 3 is adapted to threadedly engage with the exterior threaded portion of the elongated cylindrical casing 1. The threads of the resilient cap 3 extend from a cap base 27 inwardly toward the crown 28 of the resilient cap 3. The crown 28 of the resilient cap 3 has a symmetrical recess 29 straddling an extruded portion 30 within the crown 28 of the resilient cap 3.

In a closed position, the resilient cap 3, seats adjacent to and flush with the threaded flange 2. Prototypes of the present invention use any number of conventional plastics for this unit, and accordingly their composition is not further specified, because it would be readily understood by one having a modicum of skill in the art.

Referring to FIG. 2(*b*), the retractable flat locking member 4, is slidingly disposed within the interior of the elongated cylindrical casing 1. The retractable flat locking member 4 has a pair of scissor tails 23 which extend from a bisecting shank 31 connected to a base 32. The base 32 has a notched distal end 33. When the quick releasable mounting device is in a secured closed position, the peripheries of the scissor tails 23 have a chamfered outside edge 34 which is juxtaposed adjacent to the first shoulder 19 of the elongated cylindrical casing 1. In the optimum secured position the shank 31 is disposed between the second shoulder 20, interior to the elongated cylindrical casing 1. The outward facing notched distal end 33 of the base 32 is adapted to mate with, an inverted, and inwardly disposed notched end 35 from the flat bracket connector 6.

The flat bracket connector 6 has a structural configuration consisting of a concentric circular connector 36 flange which is disposed between an inverted, and inwardly extending notched end 35 and an outwardly extended flat slotted end 37. The extending flat slotted end 37 is shouldered by a step 38 to prevent direct contact of a window guard with the circular flange. When the quick release mounting device is in a secured closed position, the circular flange 36 seats flush with the exterior wallboard. The quick releasable mounting device is fixedly engaged, when the retractable flat locking member 4 and the flat bracket connector 6 are respectively mating by their adjoining notched ends (33,35). Within the elongated cylindrical casing 1, the retractable flat locking member 4 and the flat bracket connector 6 are further held in position by a closely engaged slotted interior cavity 18 which prevents disengagement.

Referring now to FIG. 2(*b*), a pair of compression springs (7,9) are disposed within the elongated cylindrical casing 1. The compression springs are adapted to urge the quick releasable mounting device, to disengage, allowing for a window guard to be opened. A first compression spring 7 is positioned between the circular base 25 of the flat tail key 5 and the threaded first end 15 of the elongated cylindrical casing 1. The second compression spring 9, is disposed between the flat-faced rear end of the substantially second larger shoulder 20 within the elongated cylindrical casing 1 and the shank-side edge of the base 32 of the retractable flat locking member 4.

When the resilient cap 3 has either been broken or unscrewed, the compression springs (7 and 9) urge the quick releasable mounting device to disengage. The first compression spring 7, is adapted to urge the flat tail key 5 out from within the scissor tails 23, freeing the scissor tails 23 from between a fist shoulder 19 and the flat tail key 5. Simultaneously the second compression spring 9 urges the retractable flat locking member 4 outward from the elongated cylindrical casing 1, toward the exterior wallboard. When the inverted, notched end 35 of the flat bracket connector 6 has cleared the exterior wallboard, the mating notched ends (33,35) of the retractable flat locking member 4, and the flat bracket connector 6 will disengage allowing for a guard securing a window to be removed allowing for egress.

Referring now to FIG. 3(*a*), the illustrated preferred embodiment is shown in a forward view of the quick releasable mounting device in assembled relationship as described above and including mounting base 8.

The preferred embodiment can further be interposed through a wall, having an inner and outer wallboard, wherein a mounting base 8 is tangentially affixed to the elongated cylindrical casing 1. The mounting base 8 includes a plurality of regularly sized apertures 39, adapted for receiving a plurality of fasteners. Fasteners could be of various types including screws and nails. The fastener type, selection and usage with the teachings of the present invention would be within the knowledge of one of ordinary skill in the art, and accordingly, further description of same has been omitted. The mounting base 8 is adapted to fasten to wood, known studs within walls, or alternatively to metal structures, which would likewise be within the skill level of one of ordinary skill in the art as of the date of filing of the instant application.

Furthering referring to FIG. 3(*b*), a cross-sectional view of the quick releasable mounting device of a preferred embodiment of the present invention in an assembled relationship including the mounting base 8, viewed from a reference position designated "B—B". The cross-section view shows that the elongated cylindrical casing 1 can be set into the mounting base 8, wherein the edge of the mounting base 8 is recessed by the elongated cylindrical casing 1 allowing for compactability and enhanced rigidity.

Figures 4, 5:
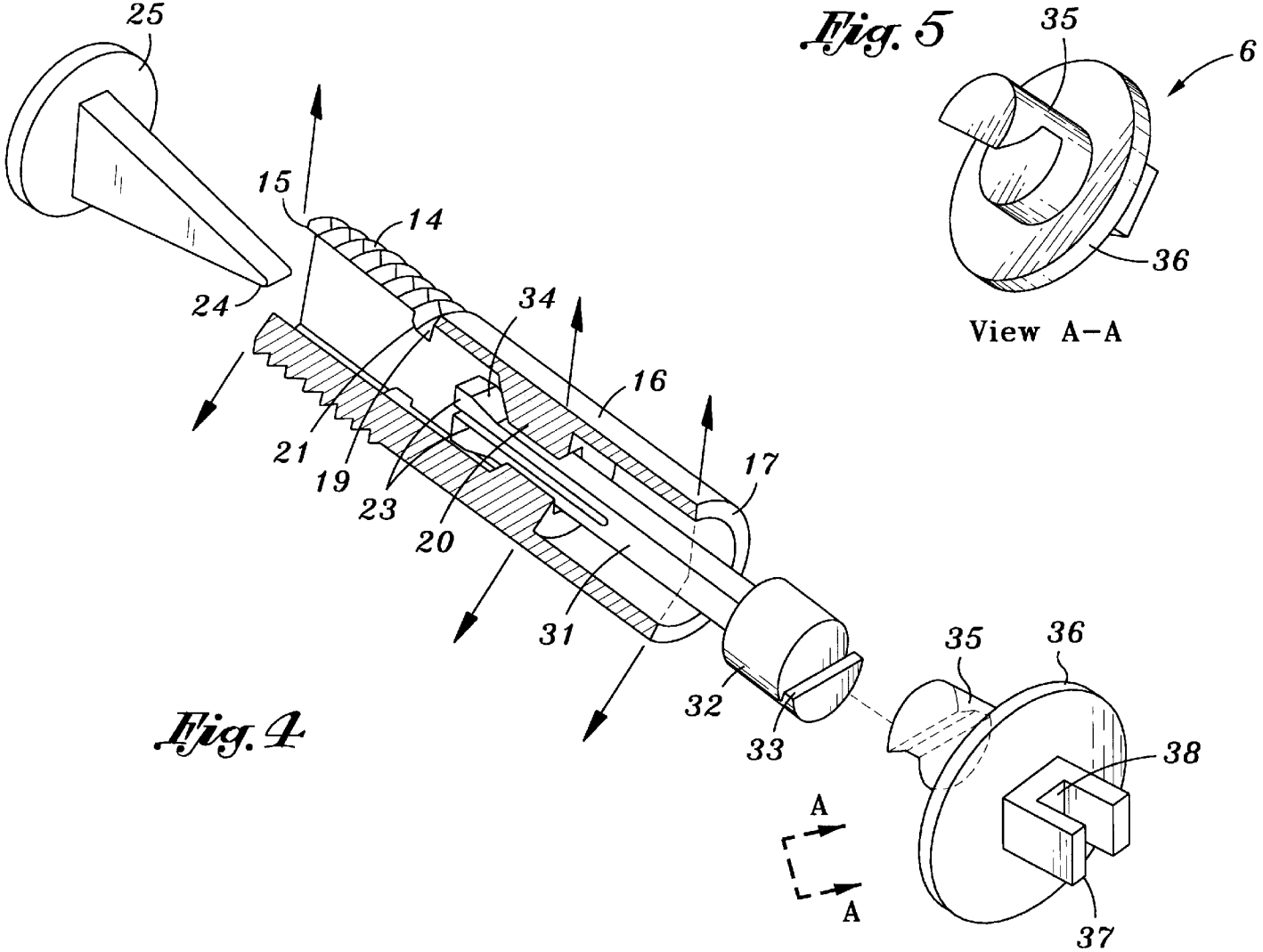
FIG. 4 is a exploded isometric view of elements showing the internal working of a preferred embodiment of the present invention with springs and caps removed from the diagram for clarity.
FIG. 5 is a detailed view showing a 90 degree rotation relative to the axis labeled A—A in FIG. 4 according to an embodiment.

FIG. 4 is a partial exploded isometric view of elements showing the internal working of a preferred embodiment of the present invention with springs (7,9) and caps removed from the diagram for clarity. As discussed above, each previously identified element is shown with the exception of springs (7,9) and caps the retractable flat locking member 4, is slidingly disposed within the interior of the elongated cylindrical casing 1. The retractable flat locking member 4 has a pair of scissor tails 23 which extend from a bisecting shank 31 connected to a base 32. The base 32 has a notched distal end 33. When the quick releasable mounting device is in a secured closed position, the peripheries of the scissor tails 23 have a chamfered outside edge 34 which is juxtaposed adjacent to the first shoulder of the elongated cylindrical casing 1. In the optimum secured position the shank is disposed between the second shoulder 20, interior to the elongated cylindrical casing 1. The outward facing notched distal end 33 of the base 32 is adapted to mate with, an inverted, and inwardly disposed notched end 35 from the flat bracket connector 6.

FIG. 5 is a detailed view showing a 90 degree rotation relative to the axis labeled A—A in FIG. 4, according to an embodiment. In this figure, a flat bracket connector 6 is shown in detailed view wherein a flat bracket connector 6 has a structural configuration consisting of a concentric circular flange 36 which is disposed between an inverted, and inwardly extending notched end 35 and an outwardly extended flat slotted end 37.

Alternately, according to the present invention means are employed which matingly engage a notched end 35 of a flat bracket connector 6 having a distinct geometric and spatial orientation but performing an analogous function.

Figure 6:
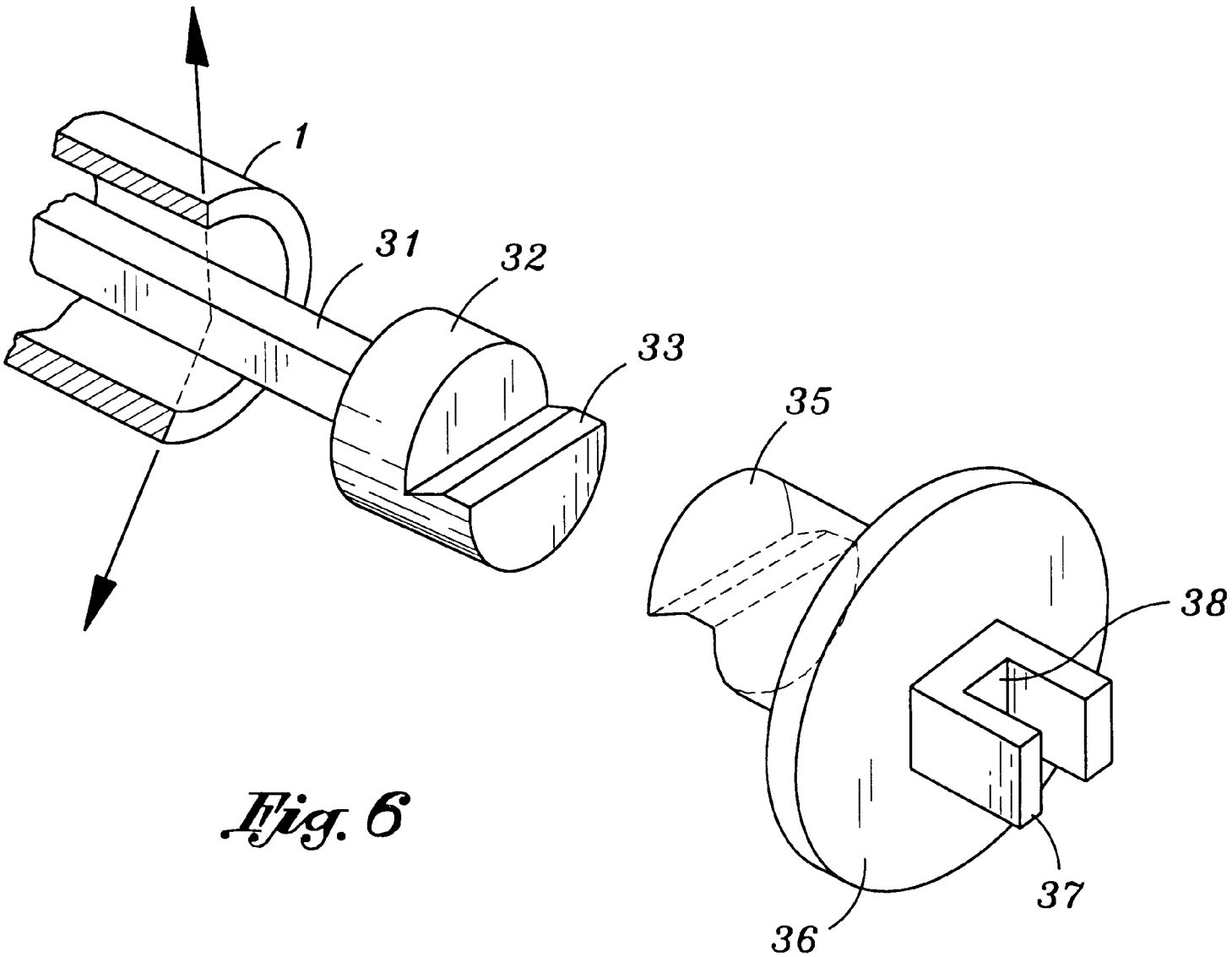
FIG. 6 is a view of a threaded attaching apparatus according to an embodiment of the present invention.

FIG. 6 is a view of a threaded attaching apparatus according to an embodiment of the present invention, wherein a flat bracket connector 6 is shaped with a mating notched back end 35.

Figure 7:
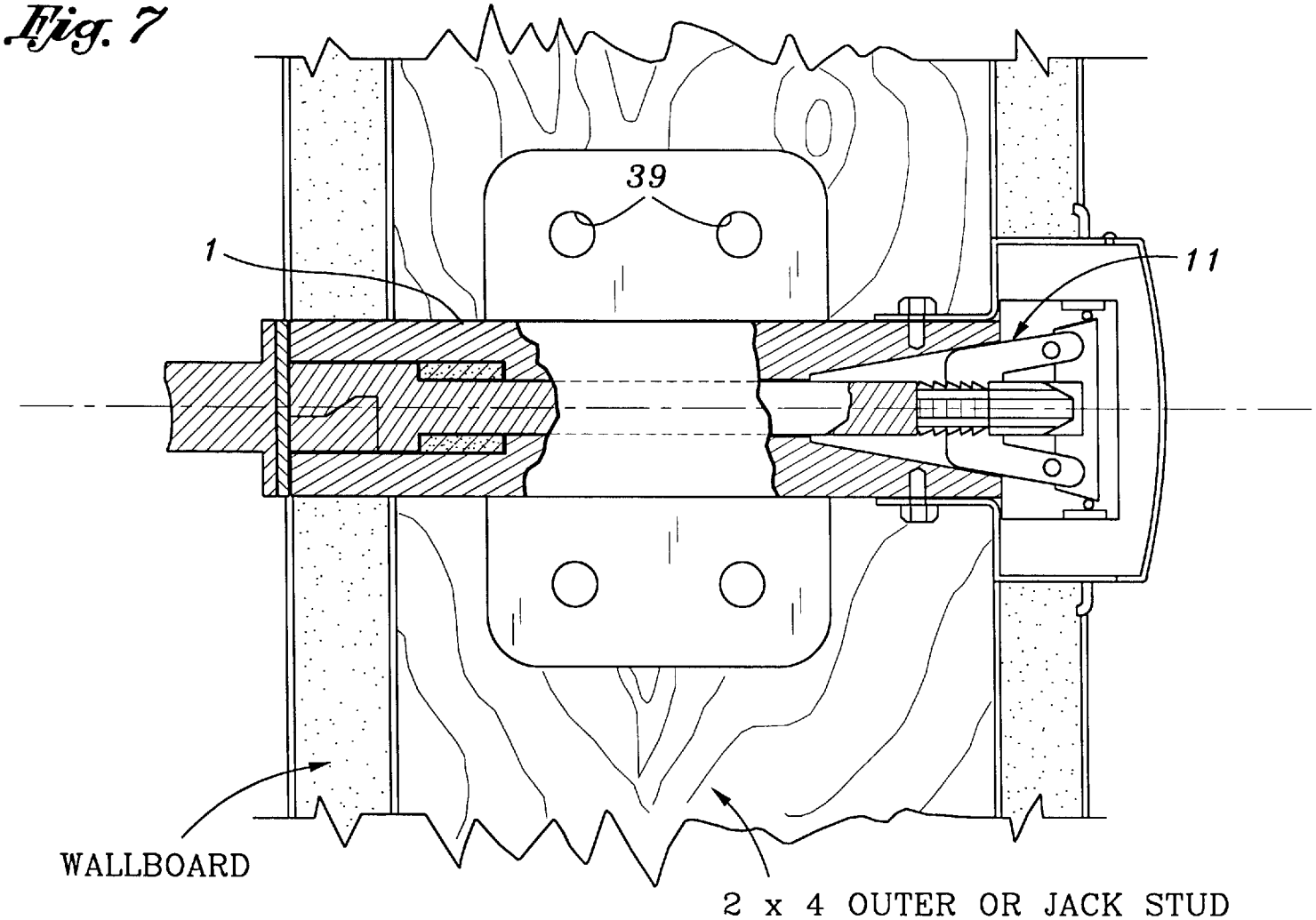
FIG. 7 is an alternate embodiment of a threaded attaching apparatus fitted with tongue means as an alternate embodiment of the present invention.

FIG. 7 is an alternate embodiment of a threaded attaching apparatus fitted with tongue means as an alternate embodiment of the present invention, one who is familiar with the level of skill in the art will readily understand how to substitute this feature for that of a threaded flange 2, as described above. Threaded tongs 11, perform an analogous function to that of a threaded flange 2.

Likewise, as shall be readily apparent to those having a modicum of skill in the art, a plurality of means exist for creating, machining, or otherwise assemblying the elements of the components of the present invention. The present inventor has alternately experimented with rolling, molding or extruding to creatre ech of the component parts of the present invention.

In the foregoing description, certain terms have been used for brevity, clearness and understanding, but no unnecessary limitations are to be implied therefrom beyond the requirements of the prior art, because such words are used for descriptive purposes herein and are intended to be broadly construed.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A quick releasable mounting for window guards comprising:

an elongated cylindrical casing, having a first end, a second end, an interior and exterior, said exterior is threaded at said first end extending inwardly to a predetermined distance, ending and mating with a substantially smooth surface, wherein said smooth surface extends from said predetermined distance to a second end, said elongated cylindrical casing has an interior slotted cavity wherein said cavity is concentrically divided by a first shoulder and a second shoulder, wherein said second shoulder is substantially larger then said first shoulder, each of said shoulders respectively have, a chamfered front end, and a flat-faced rear end, said first shoulder is located proximately adjacent said predetermined distance of said threaded first end and said smooth surface interface, said second shoulder is located central to said elongated cylindrical casing;

a threaded flange wherein said threaded flange has an interior thread diameter substantially equal to an outer diameter of said threaded first end upon said exterior of said elongated cylindrical casing;

a resilient cap, having an interior cavity with an internal diameter substantially equal to said exterior diameter of said threaded first end of said elongated cylindrical casing, extending from a base inwardly to a crown of said resilient cap, wherein said cavity has a threaded interior diameter extending from said base inwardly toward said crown of said resilient cap, said crown has a symmetrical recess, straddling an extruded central portion of said cap, said resilient cap has a means for threaded fastening to said threaded first end of said elongated cylindrical casing wherein said base of said resilient cap seats sufficiently flush to said threaded flange;

a retractable flat locking member slidingly disposed within said interior slotted cavity of said elongated cylindrical casing wherein said retractable flat locking member has a pair of scissor tails extending from a bisecting shank connected to a base wherein said base has a notched distal end, at least one of said scissor tails has a periphery with a chamfered outside edge juxtaposed adjacent to said first shoulder of said elongated cylindrical casing, said bisecting shank is disposed between said second shoulder of said elongated cylindrical casing;

a flat tail key having a circular base wherein said flat tail key tapers inwardly and into a rounded terminal end, in an axial direction from said circular base to a distal position, wherein said distal position is central to said scissor tail of said retractable flat locking member wherein said rounded terminal end is adapted to slidingly engage an interior portion of said scissor tails forcing said peripheries of said scissor tails into a trapped position adjacent said first shoulder of said elongated cylindrical casing, said circular base seats adjacent to said crown of said resilient cap, flush with said extruded central portion therefor;

a flat bracket connector having a concentric circular flange disposed between an inverted and inwardly extending notched end and an outwardly extended flat slotted end wherein said flat slotted end is shouldered by a step, said inverted and inwardly extended notched end is adapted to mate with said notched distal end of said retractable flat locking member within said interior slotted cavity of said elongated cylindrical casing, wherein said concentric circular flange seats adjacent to an outer rim of said second end of said elongated cylindrical casing; and a pair of compression springs, wherein a first compression spring is positioned between said base of said flat tail key and said threaded first end of said elongated cylindrical casing and a second compression spring disposed between said flat-faced rear end of said second shoulder and a shank-side edge of said base of said retractable flat locking member, said first compression spring is adapted to urge said flat tail key outwardly from within said interior portion of said scissor tails, said second compression spring is adapted to urge said retractable flat locking member outwardly from within said elongated cylindrical casing, said compression springs are adapted to disengage said mated notched ends.

2. The quick releasable mounting for window guards, as claimed in claim 1, wherein said elongated cylindrical casing further comprises:

an orientation interposed there between a wall having an inner and outer wall panel, wherein both of said walls are perforated by a through-going aperture wherein said perforation is substantially equal to the outer diameter of said elongated cylindrical casing.

3. The quick releasable mounting for window guards, as claimed in claim 2, wherein said mounting is effective for use with a wall selected from the group consisting of wooden walls and metal stud walls.

4. The quick releasable mounting for window guards as claimed in claim 3, wherein said elongated cylindrical casing further comprises:

a tangentially extending neck flange fitted with a plurality of apertures adapted for receiving a plurality of fasteners wherein said neck flange extends from said elongated cylindrical casing; and means for fixedly attaching said elongated cylindrical casing onto a wall.

5. The quick releasable mounting for window guards, as claimed in claim 4, wherein said notched distal end of said retractable flat locking member within said interior slotted cavity of said elongated cylindrical casing is adapted to mate with a notched back of a flat bracket connector having a stepped and angled top surface.

6. The quick releasable mounting for window guards, as claimed in claim 4, wherein said interior slotted cavity is concentrically divided by at least three shoulders, and has an additional spring member disposed therein, adjacent a last shoulder, which spring member is released to allow for ready detachment of said quick releasable window guard.

7. The quick releasable mounting for window guards, as claimed in claim 6, further comprising a threaded tong, wherein said threaded tong has an interior thread diameter substantially equal to an outer diameter of said threaded first end upon said exterior of said elongated cylindrical casing.

8. A method of quickly releasing a window guard comprising the steps of:

providing a construction effective for interfacing with a conventional window and window guard assembly which construction further comprises, in combination:

an elongated cylindrical casing;

a threaded flange;

a resilient cap;

a retractable flat locking member;

a tail key;

a flat bracket connector;

a pair of springs; and a mounting base;

unfastening said resilient cap; and, removing said resilient cap from a front end of said cylindrical casing, allowing for a first spring to urge said tail key outwardly toward said front end from a hook attachment, allowing for a pair of scissor tails of said flat locking bar to bias inwardly toward one another thereby releasing said flat locking bar and allowing a second spring to urge said flat locking bar outwardly toward a rear end of said elongated cylindrical casing thereby releasing a bracket connector attached to a window guard.

9. A method of quickly releasing a window guard, as defined in claim 8, wherein said unfastening step further consisting of the steps of:

breaking said resilient cap.

10. A method of quickly releasing a window guard, as defined in claim 9, wherein said step of unfastening is effectuated by unscrewing said resilient cap by rotation to threadly disengage said resilient cap from said front end of said elongated cylindrical casing.

11. A quick releasable mounting construction comprising:

an elongated cylindrical casing having a first end and a second end;

a means for readily engaging said elongated cylindrical casing to a conventual window;

a means for locking disposed with said elongated cylindrical casing for retention of a conventional window guard; and the means for locking includes a first spring to urge a tail key outwardly toward a resilient cap attached to said first-end when said resilient cap is removed, thereby allowing a pair of scissor tails of a retractable locking member to bias inwardly toward one another thereby releasing said retractable locking member and allowing a spring to urge said retractable locking member outwardly toward said second end of said elongated cylindrical casing thereby releasing a bracket connector attached to said conventual window guard.

12. The quick releasable mounting construction as in claim 11 wherein the means for readily engaging is a threaded flange engaged to said first end having threads thereon and said bracket connector having a flange.

13. The quick releasable mounting construction as in claim 12 wherein the means for readily engaging further comprises a mounting base having an aperture defined therein.

* * * * *